US009691578B2

(12) United States Patent
Sforza et al.

(10) Patent No.: US 9,691,578 B2
(45) Date of Patent: Jun. 27, 2017

(54) RELAY ASSEMBLY WITH EXHAUST COVER

(71) Applicant: ABL IP Holding LLC, Conyers, GA (US)

(72) Inventors: Ernest A. Sforza, Chatsworth, CA (US); John Guthier, Chatsworth, CA (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 14/246,903

(22) Filed: Apr. 7, 2014

(65) Prior Publication Data

US 2014/0300434 A1 Oct. 9, 2014

Related U.S. Application Data

(60) Provisional application No. 61/809,730, filed on Apr. 8, 2013.

(51) Int. Cl.

| | |
|---|---|
| ***H01H 50/12*** | (2006.01) |
| ***H01H 50/04*** | (2006.01) |
| ***H01H 49/00*** | (2006.01) |
| ***H01H 9/34*** | (2006.01) |
| ***H01H 50/02*** | (2006.01) |

(52) U.S. Cl.

CPC ..... *H01H 50/12* (2013.01); *H01H 9/342* (2013.01); *H01H 49/00* (2013.01); *H01H 50/02* (2013.01); *H01H 50/04* (2013.01); *H01H 2009/343* (2013.01); *H01H 2009/347* (2013.01); *Y10T 29/49105* (2015.01)

(58) Field of Classification Search

CPC ..... H01H 45/02; H01H 45/06; H01H 45/12; H01H 50/02; H01H 50/12; H01H 2009/343

USPC ..... 335/78–86

See application file for complete search history.

(56) References Cited

U.S. PATENT DOCUMENTS

| | | | |
|---|---|---|---|
| 3,328,553 | A | 6/1967 | Gryctko |
| 5,166,651 | A | 11/1992 | Jacobs et al. |
| 5,569,894 | A | 10/1996 | Uchida et al. |
| 5,710,402 | A | 1/1998 | Karnbach et al. |
| 5,753,878 | A | 5/1998 | Doughty et al. |

(Continued)

FOREIGN PATENT DOCUMENTS

| | | |
|---|---|---|
| DE | 8531352 | 1/1986 |
| EP | 1308973 | 5/2003 |

(Continued)

OTHER PUBLICATIONS

English translation of DE8531352 (Siemens AG).*

(Continued)

*Primary Examiner* — Ramon M Barrera

(74) *Attorney, Agent, or Firm* — Kilpatrick Townsend & Stockton, LLP

(57) ABSTRACT

In some aspects, a relay assembly having an exhaust cover is provided. The relay assembly can include a housing, a relay enclosed within the housing, and the exhaust cover. The exhaust cover can be positioned in an opening of the housing that is adjacent to the relay. The exhaust cover can move in a direction away from the relay in response to a pressure generated inside the housing by the relay being communicated to the exhaust cover.

16 Claims, 5 Drawing Sheets

(56) References Cited

U.S. PATENT DOCUMENTS

| | | | |
|---|---|---|---|
| 6,002,313 | A | 12/1999 | Mrenna et al. |
| 6,222,147 | B1 | 4/2001 | Doughty et al. |
| 7,598,833 | B1 | 10/2009 | Hodges et al. |
| 7,843,682 | B2 | 11/2010 | Leinen et al. |
| 2002/0030413 | A1 | 3/2002 | Fournier et al. |
| 2011/0067988 | A1 | 3/2011 | Elliott et al. |
| 2012/0067849 | A1 | 3/2012 | Nazeri |

FOREIGN PATENT DOCUMENTS

| | | | | |
|---|---|---|---|---|
| EP | 2790203 | | | 10/2014 |
| JP | 2008004374 | A | * | 1/2008 |
| JP | 2007043517 | | | 2/2009 |
| JP | 2009043517 | | | 2/2009 |
| JP | 2010251035 | | | 11/2010 |
| JP | 2012151070 | | | 8/2012 |

OTHER PUBLICATIONS

EP14163833.8, "Extended European Search Report," Jun. 11, 2014, 8 pages.
Office Action for Canadian Application No. CA 2,848,435, mailed Jul. 9, 2015, 4 pages.
Office Action for Canadian Patent Application No. CA 2,848,435, mailed May 24, 2016, 4 pages.
Office Action for European Patent Application No. EP 14163833.8, mailed Jul. 18, 2016, 4 pages.
Office Action for Canadian Application No. CA 2,848,435, mailed Nov. 8, 2016, 4 pages.

* cited by examiner

RELAY ASSEMBLY WITH EXHAUST COVER

CROSS-REFERENCE TO RELATED APPLICATIONS

This application claims priority to U.S. Provisional Application Ser. No. 61/809,730 filed Apr. 8, 2013 and titled "Relay Assembly with Exhaust Cover," the contents of which are hereby incorporated by reference.

FIELD OF THE INVENTION

The present invention is directed to powering electrical devices and more particularly relates to a relay assembly having an exhaust cover.

BACKGROUND

The installation of electrical wiring and equipment may involve installing electromechanical relays in a building or other structure. Electromechanical relays are used to switch electrical circuits between different states. For example, an electromechanical relay may include a switch in an electrical circuit that is used to switch the electrical circuit between an "ON" state in which current flows through the electrical circuit and an "OFF" state in which no current flows through the electrical circuit.

A relay assembly can include a sealed housing in which a relay used to actuate an electrical device is disposed. In some cases, unwanted pressure may be generated in the sealed housing. Such pressure may be generated from arcing caused by electrical switching contacts of the relay being engaged and/or disengaged.

For example, in a normal switching operation of a relay, setting the relay to an open or closed position (e.g., moving an armature between contacts of the relay) can cause arcing (i.e., sparks formed by current-carrying contacts being separated). The arcing can generate heat inside a relay assembly. The heat can increase pressure inside the housing of the relay assembly. Short circuit conditions in an electrical circuit that includes a relay may result in excessive current flowing through the contacts of the relay. A short circuit condition may be caused by, for example, an incorrect connection in an electrical circuit and/or a short in a line of an electrical circuit including the relay. Excessive currents caused by a short circuit can generate more powerful arcing in response to switching of the relay. More powerful arcing can generate more heat and thereby create larger increases in pressure than may be caused by normal switching operations of the relay.

Excessive amounts of pressure inside the housing of the relay assembly may exceed the ability of the housing to contain the pressure. The pressure exceeding the containment ability of the housing can cause the housing to rupture. Rupturing the housing may allow the expulsion of plasma, molten material, and/or projectile pieces in an uncontrolled and unpredictable manner, which may result in hazardous conditions.

Designing a housing that can withstand the explosive pressures resulting from high-current short circuit conditions of a relay can involve using a higher strength design with an increased number of fasteners or fasteners of higher strength. Use of such a higher strength design with an increased number of fasteners or fasteners of higher strength may increase costs associated with manufacturing a relay assembly.

It is desirable to provide a simplified relay assembly that can maintain structural integrity in response to excessive pressure being generated within the relay assembly.

SUMMARY

In some aspects, a relay assembly having an exhaust cover is provided. The relay assembly can include a housing, a relay enclosed within the housing, and the exhaust cover. The exhaust cover can be positioned in an opening of the housing that is adjacent to the relay. The exhaust cover can move in a direction away from the relay in response to a pressure generated inside the housing by the relay being communicated to the exhaust cover.

These and other aspects, features and advantages of the present invention may be more clearly understood and appreciated from a review of the following detailed description and by reference to the appended drawings and claims.

DETAILED DESCRIPTION

Certain aspects provide a relay assembly having an exhaust cover. The relay assembly with the exhaust cover can allow for venting of lower pressures caused by normal switching operations of a relay. The relay assembly with the exhaust cover can also allow for venting of high pressures generated inside the housing of the relay assembly by a short circuit or other malfunction of the switching operation of a relay. The exhaust cover can be designed, manufactured, or otherwise adapted to create an opening through which excessive pressure can be expelled. Expelling excessive pressure can prevent dangerous expulsion of gas and/or plasma without increasing costs associated with manufacturing a relay housing to be sufficiently sturdy to withstand the excessive pressure without rupturing.

Detailed descriptions of certain aspects and examples are discussed below. These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples but, like the illustrative aspects and examples, should not be used to limit the present invention.

Figure 1:
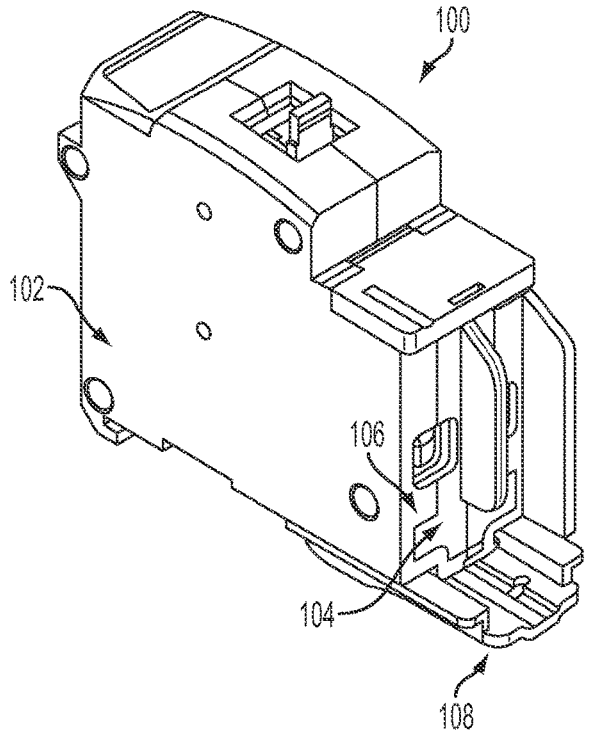
FIG. 1 is a perspective view depicting an example of a relay assembly having an exhaust cover.

FIG. 1 is a perspective view depicting an example of a relay assembly 100. The relay assembly 100 depicted in FIG. 1 includes a housing 102 that has an exhaust cover 104. The exhaust cover 104 is defined by seam gaps 106 in the housing 102. The relay assembly 100 can be coupled to or otherwise retained on a DIN rail or other equipment rack via an extended DIN clip 108 or suitable other retaining structure.

Figure 2:
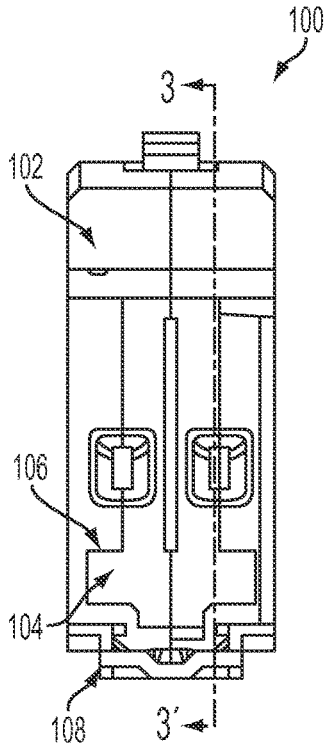
FIG. 2 is a lateral view depicting the relay assembly of FIG. 1.

FIG. 2 is a lateral view depicting the relay assembly 100. As depicted in FIG. 2, the seam gaps 106 can define the shape of the exhaust cover 104.

Figure 3:
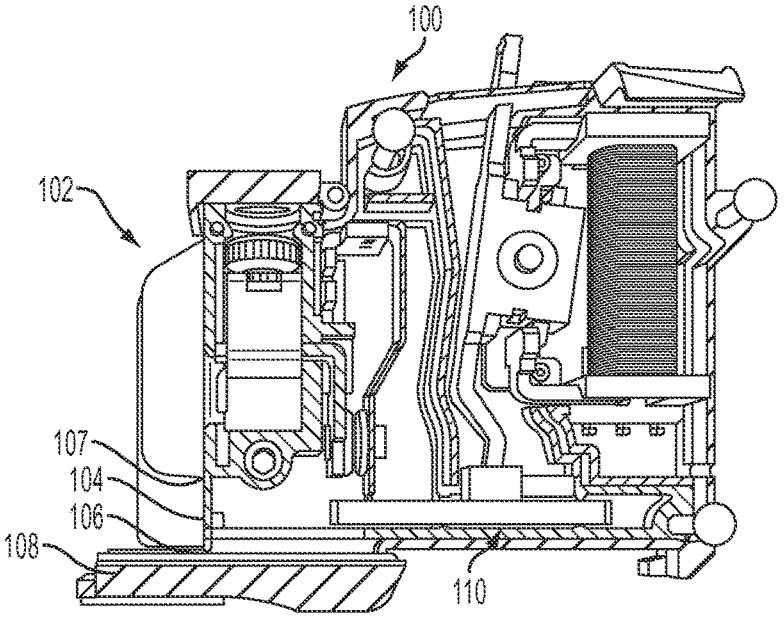
FIG. 3 is a cross-section view taken along the line shown in FIG. 2 and depicting a relay within the relay assembly of FIG. 1.

FIG. 3 is a cross-section view of the relay assembly 100 that is taken along the line 3-3' shown in FIG. 2. As depicted in FIG. 3, the relay assembly 100 includes a relay 110 disposed in the housing 102. The seam gaps 106 defining the exhaust cover 104 can allow for the venting of low internal gas pressures that are caused by switching operations of the relay 110 or that otherwise occur during switching operations of the relay 110. In some aspects, the seam gaps 106 can block or otherwise restrict dust and other debris that could compromise the internal components of the relay assembly 100 from entering the housing 102.

The exhaust cover 104 can include a housing portion that is thinner or otherwise less resilient than the rest of the housing 102. The thinned portion of the exhaust cover 104 can provide a region of the housing 102 that is less sturdy than other portions of the housing 102. For example, other portions of the housing 102 can have a thickness that is sufficient to maintain structural integrity in response to high pressures being communicated to the housing 102. The exhaust cover 104 can have a reduced thickness that does not maintain structural integrity in response to high pressures being communicated to the exhaust cover 104. Using the thinned portion of the housing 102 provided by the exhaust cover 104 can control the location at which gas is expelled from the housing 102 and/or the direction in which the gas is expelled from the housing 102.

Any suitable thickness of the thinned portion that can control or otherwise affect the location or direction of gas expulsion can be used. In a non-limiting example, the thinned portion of the exhaust cover 104 may have a thickness that is 30 percent of the thickness of the nominal thickness of the rest of the housing 102.

The thinned portion of the housing 102 can provide a weak point 107 in the housing 102. The thinned portion of the exhaust cover 104 can break away from the housing 102 in response to one or more pressures in the housing 102 exceeding a threshold pressure. For example, a short circuit in the relay 110 or other malfunction may cause a pressure within the housing 102 to exceed a threshold pressure. An excessive pressure caused by a short circuit condition or other malfunction can be directed to the weak point 107. The excessive pressure being directed to the weak point 107 can cause the exhaust cover 104 to be separated from the housing 102 at the weak point 107. The separated exhaust cover 104 can move in a direction away from the housing 102. The separation of the exhaust cover 104 from the housing 102 can create an opening in the housing 102.

The opening caused by a separation of the exhaust cover 104 from the housing 102 can allow for a controlled, directed expulsion of gas from within the housing 102 to a location external to the housing 102. Expelling pressure from the housing 102 in a controlled direction can preserve the structural integrity of one or more portions of the housing 102 other than the exhaust cover 104. The expulsion of gas or pressure through the opening can also allow live conductors and other relay 110 components of the relay assembly 100 to remain intact within the housing 102 of the relay assembly 100.

In some aspects, the relay assembly 100 can satisfy higher short circuit current rating ("SCCR") requirements used for testing relay for short circuiting. For example, a SCCR requirement may specify that a majority of the housing 102 of a relay assembly 100 must stay intact in the event of a short circuit condition causing excessive gas pressure inside the housing, such that no live conductors are expelled and/or explosion plasma or molten metal is contained. The exhaust cover 104 providing a blow-out portion of the housing 102 can allow for a controlled expulsion of gas from the relay assembly 100.

Although the exhaust cover 104 is described above as breaking away from the relay assembly 100 in response to excessive pressure inside the housing 102, other implementations are possible. In some aspects, the thinned portion of the material providing the exhaust cover 104 can have sufficient flexibility to extend away from the housing 102 in response to an expulsion of gas without the exhaust cover 104 breaking away from the housing 102. In other aspects, the housing 102 can include a joint and/or hinge assembly for coupling one end of the exhaust cover 104 to the housing 102. The joint and/or hinge assembly can allow another end of the exhaust cover 104 to move outward in response to an expulsion of pressure from the housing 102.

Figure 4:
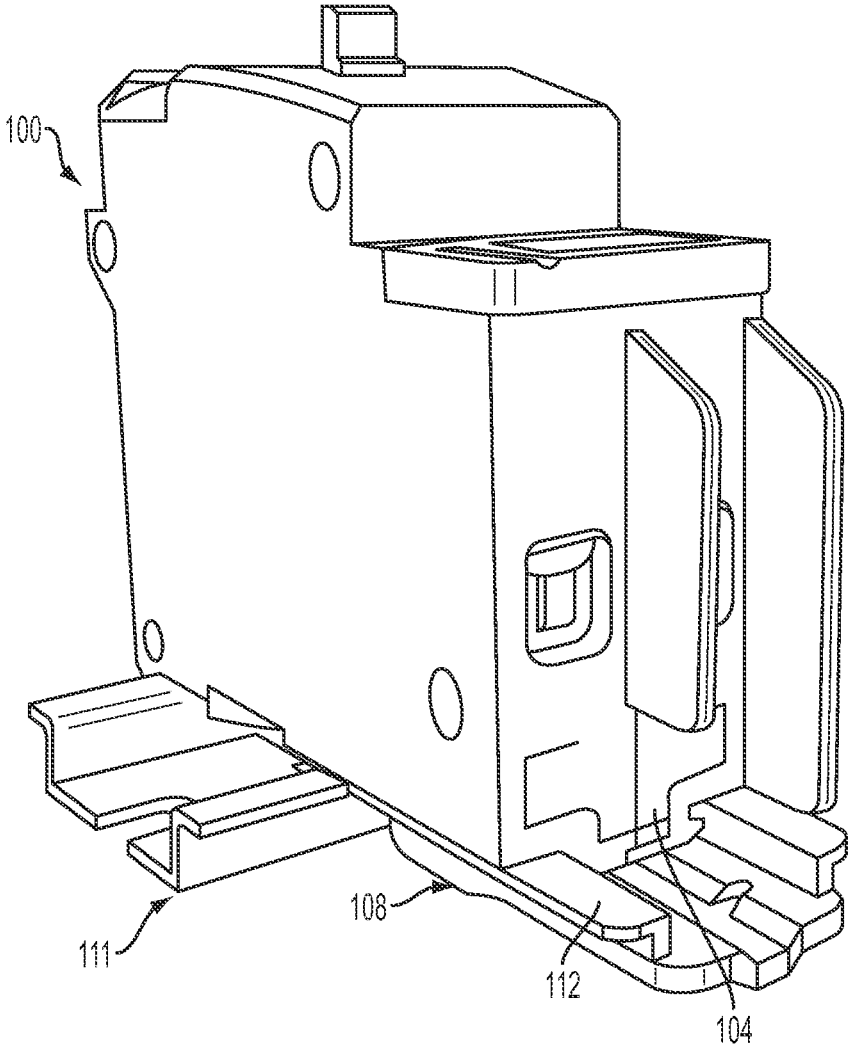
FIG. 4 is a perspective view depicting the relay assembly of FIG. 1 installed on a rack using a retaining structure with an extended portion for isolating materials expelled from within the housing of the relay assembly.

In some aspects, the relay assembly 100 can be coupled to or otherwise retained on a DIN rail 111 or other equipment rack using an extended DIN clip 108, as depicted in the perspective view of FIG. 4. The DIN clip 108 can include a portion 112 that extends in the direction in which pressure is expelled from the housing 102 of the relay assembly 100 (e.g., away from the relay 110). For example, the extended portion 112 can include extended flanged features that are located at the base of an opening provided by the exhaust cover 104.

The extended portion 112 of the DIN clip 108 can have a sufficient area to isolate plasma or other materials expelled from the housing 102 via an opening provided by the exhaust cover 104. Using the extended portion 112 of the DIN clip 108 to isolate plasma or other materials can allow the plasma or other materials to cool after being expelled from within the housing 102, thereby preventing plasma or other materials from spreading into an enclosure or other area in which the relay assembly 100 is positioned. Directing and/or isolating plasma or other material expelled from the housing 102 can provide time for heat in the expelled plasma or other material to dissipate. Non-limiting examples of factors that can be used to determine the area of the extended portion 112 can include the explosive force of the excess pressure inside the housing 102, the rate of heat dissipation from the expelled plasma or other material, and the like.

The extended portion 112 of the DIN clip 108 can also act as an isolator and/or barrier that allows the expelled gas to be directed, cooled, and/or dissipated. The extended portion 112 acting as an isolator and/or barrier can prevent arcing of current to the grounded back plate of the relay 110.

Figure 5:
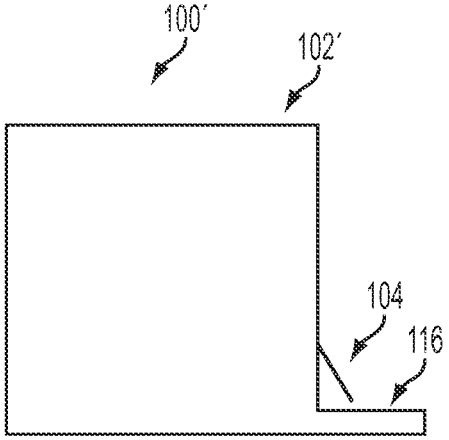
FIG. 5 is a lateral view of an alternative relay assembly having a housing that defines an extended portion for isolating expelled materials.
Figure 6:
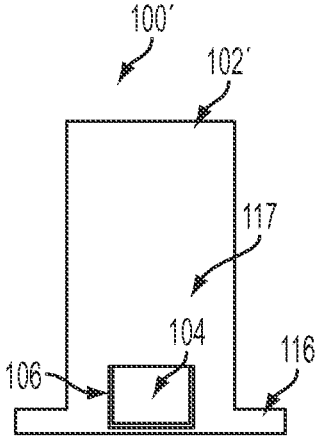
FIG. 6 is a longitudinal view of the relay assembly of FIG. 5.

In additional or alternative aspects, the relay assembly 100 can include a DIN clip without an extended portion 112. For example, a portion of the housing 102 may be formed to extend in the direction of the expelled gas or plasma, thereby providing a barrier or isolator. FIG. 5 is a lateral view of a relay assembly 100' that includes a housing 102' having a portion 116 that extends in the direction of the expelled gas or plasma. In some aspects, the portion 116 can have a width that is greater than the width of one or more other portions of the housing 102'. For example, FIG. 6 is a longitudinal view of the relay assembly 100' in which the portion 116 is wider than a portion 117 of the housing 102'. The width of the portion 116 can provide an area of the portion 116 that is sufficient to isolate plasma or other materials expelled from within the housing 102' through an opening provided by the exhaust cover 104.

Figure 7:
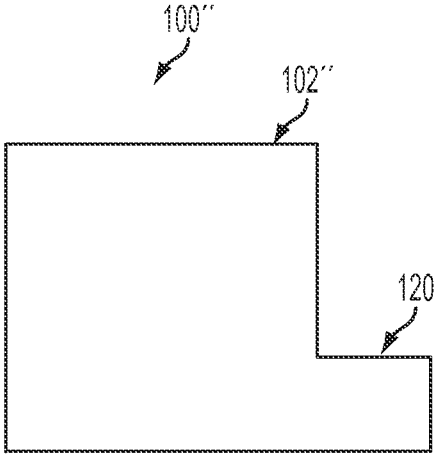
FIG. 7 is a lateral view of another alternative relay assembly having a housing with an extended portion that at least partially surrounds the exhaust cover for isolating expelled materials.
Figure 8:
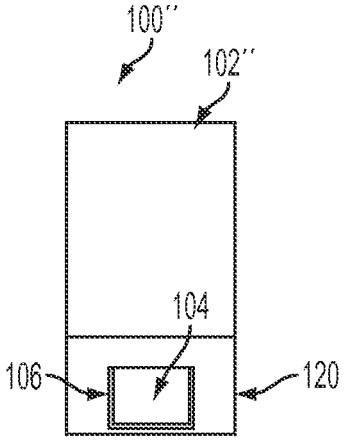
FIG. 8 is a longitudinal view of the relay assembly of FIG. 7.

In additional or alternative aspects, a portion of the housing 102 may be formed to provide a tubing section or piping section that partially or fully surrounds the perimeter of the exhaust cover 104. For example, FIG. 7 is a lateral view of a relay assembly 100" having a housing 102" with a portion 120 that at least partially surrounds the exhaust cover 104. The portion 120 can extend away from one or more other portions of the housing 102 in a direction in which gas or plasma may be expelled (e.g., away from the relay 110). The portion 120 can be, for example, a tubing section or piping section that can direct expelled gas and/or plasma away from the housing 102. In some aspects, the portion 120 can fully surround the perimeter of the exhaust cover 104, as shown in the longitudinal view of the relay assembly 100" depicted in FIG. 8. In other aspects, the portion 120 can partially surround the perimeter of the exhaust cover 104.

Figure 9:
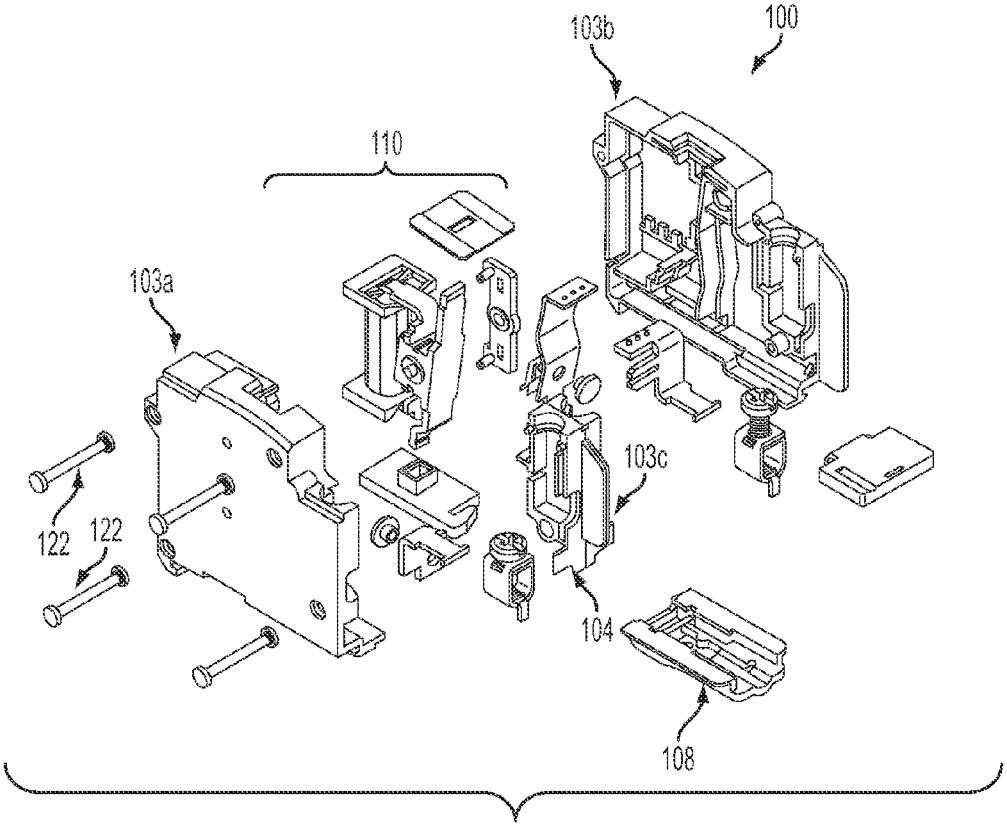
FIG. 9 is an exploded view depicting the relay assembly of FIG. 1.

FIG. 9 is an exploded view of the relay assembly 100. The housing 102 of the relay assembly 100 can be manufactured by coupling together the housing portions 103*a-c*. The housing portion 103*c* can include the exhaust cover 104. The housing portions 103*a*, 103*b* can be positioned on opposite sides of the housing portion 103*c*. The housing portions 103*a*, 103*b* that are positioned on opposite sides of the housing portion 103*c* can be coupled together. Coupling or otherwise attaching the housing portions 103*a-c* together can cause seam gaps 106 to be formed between the housing portions 103*a*, 103*c* and between the housing portions 103*b*, 103*c*. The housing portions 103*a-c* can be coupled together using any suitable mechanism, component, material, etc. For example, as depicted in FIG. 9, fasteners 122 can be inserted through respective openings in the housing portions 103*a*, 103*b* to couple the housing portions 103*a*, 103*b* together.

The housing portions 103*a-c* can be formed via any suitable process, such as injection molding. The housing portions 103*a-c* can be formed from any suitable material. For example, the housing portions 103*a-c* may be formed from a fiberglass reinforced nylon-based plastic or other suitable plastic.

Figure 10:
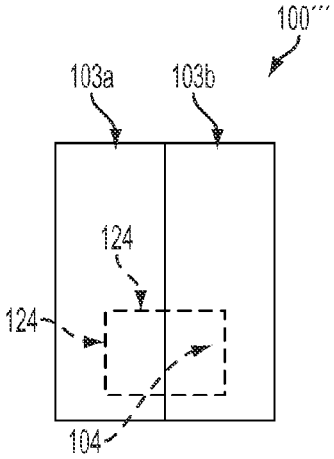
FIG. 10 is a longitudinal view depicting a relay assembly having an exhaust cover defined by perforations in one or more sections of the relay housing.

Although the housing 102 is described above with respect to FIG. 9 as being manufactured from three housing portions 103*a-c* that are coupled or otherwise attached together, other implementations are possible. For example, FIG. 10 is a longitudinal view depicting a relay assembly 100"' in which the exhaust cover 104 is defined by perforations 124 in housing portions 103*a*, 103*b*. The exhaust cover 104 may be formed by coupling or otherwise attaching the housing portions 103*a*, 103*b* together. One or both of the housing portions 103*a*, 103*b* can include a thinned portion from which the exhaust cover 104 can be defined. The exhaust cover 104 can be defined by a series of perforations 124 in one or both of the housing portions 103*a*, 103*b*. The perforations can allow for venting of gas caused by normal switching operation of the relay 110. The perforations can allow the exhaust cover to break away from the housing in response to pressure inside the housing exceeding a threshold amount of pressure.

Figure 11:
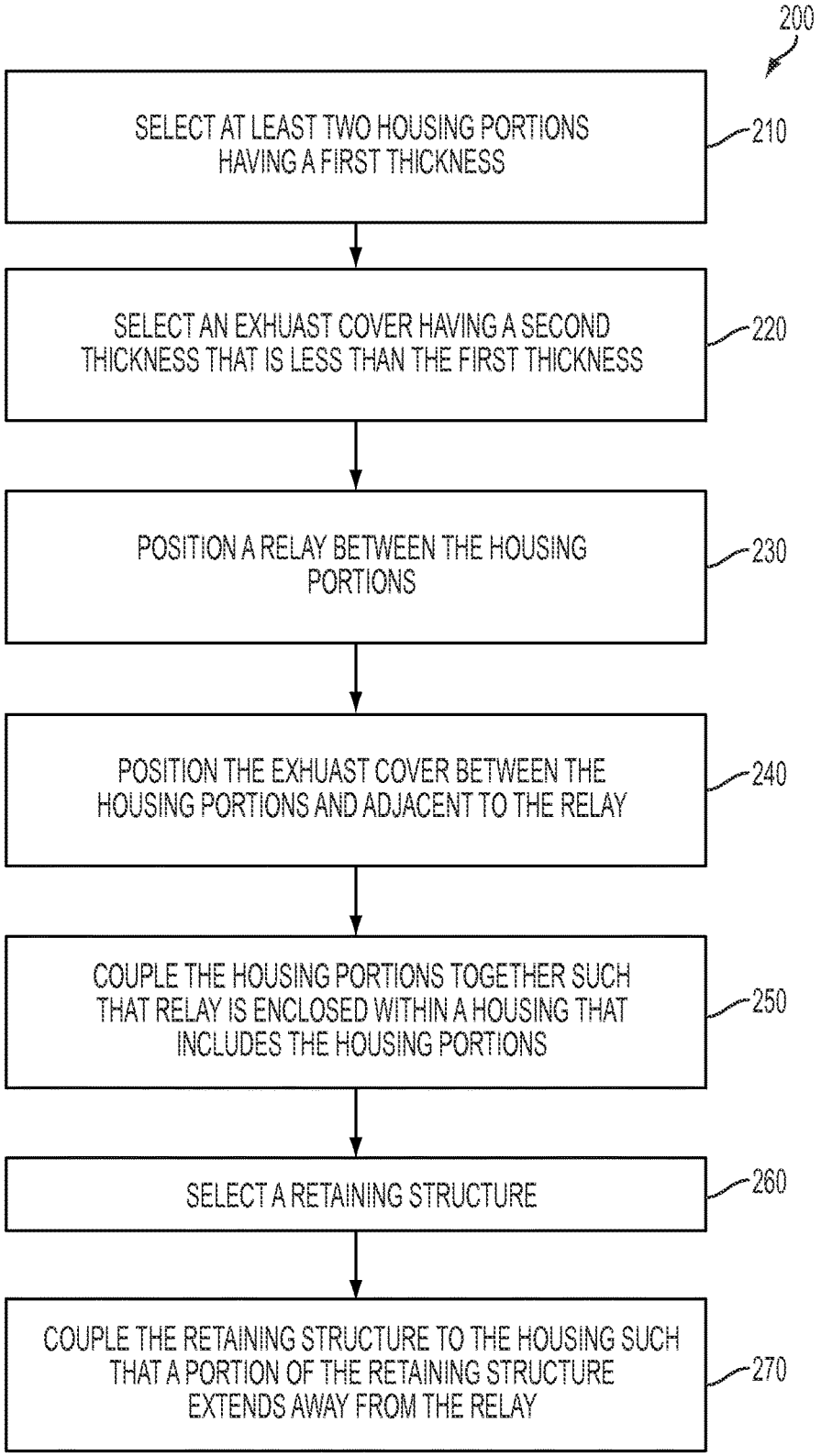
FIG. 11 is a flow chart illustrating an example of a method for manufacturing a relay assembly having an exhaust cover.

FIG. 11 is a flow chart illustrating an example method 200 for manufacturing a relay assembly 100 having an exhaust cover 104.

The method 200 involves selecting at least two housing portions having a first thickness, as shown at block 210. For example, the housing portions 103*a*, 103*b* depicted in FIG. 9 can be selected. In some aspects, the housing portions 103*a*, 103*b* can be selected based on the first thickness being greater than or equal to a threshold thickness. The threshold thickness can be any thickness that is sufficient for the relay assembly 100 to retain structural integrity in response to pressure generated inside the housing 102 being communicated to one or more of the housing portions 103*a*, 103*b*. For example, the threshold thickness may be sufficient to withstand a pressure generated by a short circuit or other malfunction in the relay assembly 100. The threshold thickness can be identified based on a maximum or expected pressure that may be generated by a short circuit in the relay assembly 100 or other malfunction of the relay 110.

The method 200 also involves selecting an exhaust cover 104 having a second thickness that is less than the first thickness, as shown at block 220. For example, the housing portion 103*c* depicted in FIG. 9 can be selected. In some aspects, the exhaust cover 104 can be selected based on the thickness of the exhaust cover 104 being less than the threshold thickness used to select the housing portions 103*a*, 103*b*. For example, the exhaust cover 104 can have a thickness that is insufficient to retain structural integrity in response to a pressure being communicated to the exhaust cover 104 from inside the relay assembly 100. The thickness of the exhaust cover 104 being insufficient to retain structural integrity can allow the exhaust cover 104 to break away or otherwise separate from the relay assembly 100 in response to a pressure from within the relay assembly 100 being communicated to the exhaust cover 104.

The method 200 also involves positioning a relay 110 between the housing portions 103*a*, 103*b*, as shown at block 230.

The method 200 also involves positioning the exhaust cover 104 between the housing portions 103*a*, 103*b* and adjacent to the relay 110, as shown at block 240. For example, the housing portion 103*c* having the exhaust cover 104 can be positioned along an edge formed by corresponding portions of the housing portions 103*a*, 103*b*, as depicted in FIG. 9.

The method 200 also involves coupling the housing portions 103*a*, 103*b* together such that the relay 110 is enclosed within the housing 102, as shown at block 250. For example, the housing portions 103*a*, 103*b* can be coupled together using fasteners 122, using a suitable adhesive, or by using any other suitable components, materials, or devices.

The method 200 also involves selecting a retaining structure, as shown at block 260. The retaining structure can include any component or structure that can be used to attach the relay assembly 100 to an equipment rack. A non-limiting example of a retaining structure is a DIN clip 108. In some aspects, the retaining structure can be selected based on a portion of the retaining structure having an area that is sufficient to isolate material expelled by pressure within the relay assembly 100. For example, a DIN clip 108 can have an extended portion 112 that is sufficient to isolate expelled plasma or other material, as described above with respect to FIG. 4.

The method 200 also involves coupling the retaining structure to the housing such that at least a portion of the retaining structure extends in the direction away from the relay 110, as shown at block 270. For example, as described above with respect to FIG. 4, a DIN clip 108 having an extended portion 112 can be coupled to the housing 102 such that the extended portion 112 extends away from an opening that can be formed by the exhaust cover 104.

In some aspects, one or more of blocks 210-270 can be omitted. For example, blocks 260, 270 can be omitted in the manufacture of a relay assembly 100 that does not include a DIN clip 108 or other retaining structure to the housing 102. One or more housing portions can be selected that define an extended portion 116 (as described above with respect to FIGS. 5-6) or an extended portion 120 (as described above with respect to FIGS. 7-8).

The foregoing disclosure, including the illustrated examples, has been presented only for the purpose of illustration and description and is not intended to be exhaustive or to limit the invention to the precise forms disclosed. Numerous modifications, adaptations, and uses thereof will be apparent to those skilled in the art without departing from the scope of this invention. The illustrative examples described above are given to introduce the reader to the general subject matter discussed here and are not intended to limit the scope of the disclosed concepts. The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below.

What is claimed is:

1. A relay assembly comprising:

a housing;

a relay enclosed within the housing;

an exhaust cover that is positioned in an opening of the housing and adjacent to the relay; and a retaining structure having a first retaining structure portion adjacent to the exhaust cover and a second retaining structure portion adapted to attach the relay assembly to an equipment rack, wherein the exhaust cover is adapted to move in a direction away from the relay and away from the equipment rack in response to a pressure generated inside the housing by the relay, wherein the retaining structure is coupled to the housing such that the first retaining structure portion extends from the housing in the direction away from the relay and away from the equipment rack, wherein the exhaust cover has a thickness such that the exhaust cover is sufficiently flexible to be moved in the direction away from the relay in response to the pressure.

2. The relay assembly of claim 1, wherein the exhaust cover is defined by the opening in the housing and further comprises at least one edge that is formed integrally with the housing, wherein the at least one edge has the thickness.

3. The relay assembly of claim 1, wherein the second portion of the housing at least partially surrounds the relay.

4. The relay assembly of claim 1, wherein the housing comprises at least two housing portions coupled together and surrounding the relay and the exhaust cover comprises an additional housing portion positioned between the at least two housing portions.

5. The relay assembly of claim 1, wherein the exhaust cover is defined by a plurality of perforations in the housing.

6. The relay assembly of claim 1, wherein the housing defines an isolation portion adjacent to the exhaust cover and extending from the housing in the direction away from the relay.

7. The relay assembly of claim 6, wherein the isolation portion surrounds the exhaust cover.

8. The relay assembly of claim 1, wherein the exhaust cover is defined by a first one of the at least two housing portions of the housing forming at least two edges of the exhaust cover.

9. The relay assembly of claim 2, wherein the pressure exceeds a threshold pressure, wherein the exhaust cover is further defined by at least one opening adapted to vent an additional pressure generated inside the housing by the relay that is less than the threshold pressure, wherein the exhaust cover is adapted to remain stationary in response to the additional pressure that is less than the threshold pressure.

10. The relay assembly of claim 9, wherein the first retaining structure portion has an area sufficient to prevent gas or liquid, which is expelled from the housing by the casing, from contacting the equipment rack.

11. The relay assembly of claim 10, wherein the area of the first retaining structure portion being sufficient to prevent the gas or liquid from contacting the equipment rack comprises a width of the first retaining structure portion being greater than the width of a portion of the housing that includes the exhaust cover.

12. A method of manufacturing a relay assembly, the method comprising:

selecting at least two housing portions, wherein each of the at least two housing portions has a first thickness;

selecting an exhaust cover having a second thickness;

wherein the second thickness is selected to provide sufficient flexibility that the exhaust moves in a direction away from the relay and away from an equipment rack to which the relay assembly is attached in response to a pressure generated inside the housing by the relay and a closing force in the absence of the pressure;

positioning a relay between the at least two housing portions;

positioning the exhaust cover between the at least two housing portions and adjacent to the relay;

coupling the at least two housing portions together such that the relay is enclosed within a housing that includes the at least two housing portions, wherein the exhaust cover is adapted to move in the direction away from the relay in response to the pressure generated inside the housing by the relay;

selecting a retaining structure based on a first retaining structure portion of the retaining structure having an area that is sufficient to isolate material expelled from the relay assembly by the pressure and a second retaining structure portion being adapted to attach the relay assembly to the equipment rack; and coupling the retaining structure to the housing such that the first retaining structure portion of the retaining structure extends in the direction away from the relay and away from the second retaining structure portion adapted to attach the relay assembly to the equipment rack.

13. The method of claim 12, wherein the at least two housing portions are selected based on the first thickness being greater than or equal to a threshold thickness that is sufficient to retain structural integrity in response to the pressure being communicated to the at least two housing portions.

14. The method of claim 13, wherein the exhaust cover is selected based on the second thickness being less than the threshold thickness such that the second thickness is insufficient to retain structural integrity in response to the pressure being communicated to the exhaust cover.

15. The method of claim 13, wherein the threshold thickness is identified based on a pressure generated by a short circuit in the relay assembly.

16. The method of claim 12, wherein the area is identified based on a pressure generated by a short circuit in the relay assembly.

* * * * *